US007937773B1

(12) United States Patent
Kleinert

(10) Patent No.: US 7,937,773 B1
(45) Date of Patent: May 10, 2011

(54) GLOVE WITH DORSAL SIDE KNUCKLE PROTECTIVE PADDING

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 708 days.

(21) Appl. No.: 11/132,090

(22) Filed: May 18, 2005

(51) Int. Cl.
*A41D 19/00* (2006.01)

(52) U.S. Cl. ..... 2/161.1; 2/159; 2/16

(58) Field of Classification Search ..... 2/158–170, 2/16–21

See application file for complete search history.

(56) References Cited

U.S. PATENT DOCUMENTS

| | | | | |
|---|---|---|---|---|
| 325,968 | A | | 9/1885 | Rawlings |
| 385,728 | A | | 7/1888 | Sauer |
| RE12,996 | E | | 7/1909 | Peach |
| 1,018,271 | A | | 2/1912 | Rogers |
| 1,202,705 | A | | 10/1916 | Goldsmith et al. |
| 1,435,478 | A | | 11/1922 | Kennedy |
| 1,436,131 | A | | 11/1922 | Whitley |
| 1,496,824 | A | | 6/1924 | Nixon, Jr. |
| 1,525,298 | A | | 2/1925 | Hartman |
| 1,552,080 | A | | 9/1925 | Rainey |
| 1,562,176 | A | | 11/1925 | Latina |
| RE16,272 | E | | 2/1926 | Green |
| D072,069 | S | | 2/1927 | Meyers |
| 1,716,221 | A | | 6/1929 | Fernie |
| 1,841,193 | A | | 1/1932 | Lidston |
| 1,900,395 | A | | 3/1933 | Gitt |
| 2,083,935 | A | | 6/1937 | Arnold |
| 2,258,999 | A | | 10/1941 | Nunn |
| 2,344,080 | A | * | 3/1944 | Burgett ..... 2/161.2 |
| 2,369,115 | A | | 2/1945 | Bloom |
| 2,465,136 | A | | 3/1949 | Troccoli |
| 2,528,802 | A | | 11/1950 | Turner |
| 2,558,544 | A | | 6/1951 | Delsalle |
| 2,636,172 | A | | 4/1953 | Stobbe |
| 2,750,594 | A | | 6/1956 | Denkert |
| 2,975,429 | A | * | 3/1961 | Newman ..... 2/161.2 |
| 2,980,915 | A | | 4/1961 | Peterson |
| 3,042,929 | A | | 7/1962 | Kobos |
| 3,096,523 | A | | 7/1963 | Bruchas |
| 3,164,841 | A | * | 1/1965 | Burtoff ..... 2/21 |
| 3,175,226 | A | | 3/1965 | Weinberg |
| 3,273,165 | A | | 9/1966 | Sperandeo |
| 3,290,695 | A | | 12/1966 | Burtoff |
| 3,300,787 | A | | 1/1967 | Denkert |
| 3,411,222 | A | | 11/1968 | Williams |

(Continued)

FOREIGN PATENT DOCUMENTS

| | | |
|---|---|---|
| GB | 710394 | 6/1954 |

(Continued)

*Primary Examiner* — Shaun R Hurley
*Assistant Examiner* — Andrew W Sutton
(74) *Attorney, Agent, or Firm* — Charles G. Lamb; Middleton Reutlinger

(57) ABSTRACT

A protective glove, particularly useful for automobile mechanic work and other types of working environments or sports which brings the dorsal side of the hand in contact with hard objects or the like which may result in injuries to the knuckles of the fingers, thumb and dorsal side of the hand is provided with protective padding positioned to circumscribe the center axis of rotation of the metacarpalphalangeal joints of the fingers and the thumb. The protective pad covers the distal ends of the metacarpals and the proximal ends of the proximal phalanxes of the fingers with padding being absent at the metacarpalphalangeal joints of the fingers.

8 Claims, 7 Drawing Sheets

U.S. PATENT DOCUMENTS

| | | | | |
|---|---|---|---|---|
| D213,287 | S | | 2/1969 | Khazzam |
| 3,458,867 | A | | 8/1969 | Moore et al. |
| 3,532,344 | A | | 10/1970 | Masstab |
| 3,564,613 | A | | 2/1971 | Fowler |
| 3,576,036 | A | | 4/1971 | Latina |
| 3,588,915 | A | | 6/1971 | Latina |
| 3,605,117 | A | | 9/1971 | Latina |
| 3,606,614 | A | | 9/1971 | Dimitroff |
| 3,649,966 | A | | 3/1972 | Shields |
| 3,707,730 | A | | 1/1973 | Slider |
| 3,918,096 | A | | 11/1975 | Lim |
| D240,671 | S | | 7/1976 | McTear |
| D240,672 | S | | 7/1976 | McTear |
| 3,997,922 | A | | 12/1976 | Huhta |
| 3,997,992 | A | | 12/1976 | Huhta |
| 4,027,339 | A | | 6/1977 | Brucker |
| 4,038,787 | A | | 8/1977 | Bianchi |
| 4,042,975 | A | | 8/1977 | Elliott, Jr. et al. |
| 4,051,552 | A | | 10/1977 | Widdemer |
| 4,051,553 | A | | 10/1977 | Howard |
| 4,067,063 | A | | 1/1978 | Ettinger |
| 4,068,312 | A | | 1/1978 | Ledesma |
| 4,084,584 | A | | 4/1978 | Detty |
| 4,095,292 | A | | 6/1978 | Klein |
| D248,898 | S | | 8/1978 | DeLeone et al. |
| 4,137,572 | A | | 2/1979 | Jansson et al. |
| 4,187,557 | A | | 2/1980 | Tombari |
| 4,201,203 | A | | 5/1980 | Applegate |
| 4,250,578 | A | | 2/1981 | Barlow |
| 4,272,849 | A | | 6/1981 | Thurston et al. |
| 4,272,850 | A | | 6/1981 | Rule |
| 4,287,885 | A | | 9/1981 | Applegate |
| 4,329,741 | A | | 5/1982 | Bach |
| 4,346,481 | A | | 8/1982 | Latina |
| 4,438,532 | A | | 3/1984 | Campanella et al. |
| 4,445,507 | A | | 5/1984 | Eisenberg |
| 4,524,464 | A | | 6/1985 | Primiano et al. |
| 4,546,495 | A | | 10/1985 | Castillo |
| 4,561,122 | A | | 12/1985 | Stanley et al. |
| 4,570,269 | A | | 2/1986 | Berlese |
| 4,589,146 | A | | 5/1986 | Taylor |
| 4,590,625 | A | | 5/1986 | Keim |
| 4,630,318 | A | | 12/1986 | Aoki |
| 4,663,783 | A | | 5/1987 | Obayashi |
| 4,665,561 | A | | 5/1987 | Aoki |
| 4,677,698 | A | | 7/1987 | Angas |
| 4,684,123 | A | | 8/1987 | Fabry |
| 4,691,387 | A | | 9/1987 | Lopez |
| 4,700,404 | A | | 10/1987 | Lespérance |
| D294,984 | S | | 3/1988 | Green |
| 4,747,163 | A | | 5/1988 | Dzierson |
| 4,748,690 | A | | 6/1988 | Webster |
| 4,751,749 | A | | 6/1988 | Cowhey |
| 4,766,612 | A | | 8/1988 | Patton, Sr. |
| 4,815,147 | A | | 3/1989 | Gazzano et al. |
| 4,847,915 | A | | 7/1989 | Keene |
| 4,850,053 | A | | 7/1989 | Tepley et al. |
| 4,864,659 | A | | 9/1989 | Morris |
| 4,864,660 | A | | 9/1989 | Sawyer |
| 4,891,845 | A | | 1/1990 | Hayes |
| 4,896,376 | A | | 1/1990 | Miner |
| 4,911,433 | A | | 3/1990 | Walker et al. |
| 4,930,162 | A | | 6/1990 | Côté |
| 4,958,384 | A | * | 9/1990 | McCrane ..... 2/161.6 |
| 4,967,418 | A | | 11/1990 | Marcotte |
| 5,004,227 | A | | 4/1991 | Hoffman |
| 5,016,286 | A | | 5/1991 | Henriksen |
| 5,028,050 | A | | 7/1991 | Freyer |
| 5,031,238 | A | * | 7/1991 | Hayes ..... 2/19 |
| 5,058,209 | A | | 10/1991 | Eisenberg |
| 5,067,175 | A | | 11/1991 | Gold |
| 5,083,361 | A | | 1/1992 | Rudy |
| 5,107,544 | A | | 4/1992 | Capatosto |
| D328,369 | S | | 7/1992 | Hong |
| 5,136,725 | A | | 8/1992 | Montero |
| 5,146,624 | A | | 9/1992 | Brückner |
| 5,168,576 | A | | 12/1992 | Krent et al. |
| 5,168,578 | A | | 12/1992 | Stanley |
| D332,845 | S | | 1/1993 | Johnston |
| 5,175,886 | A | | 1/1993 | Suk |
| 5,195,188 | A | | 3/1993 | Bourdeau et al. |
| 5,214,799 | A | | 6/1993 | Fabry |
| 5,218,718 | A | | 6/1993 | Chih |
| 5,218,719 | A | | 6/1993 | Johnson |
| D338,280 | S | | 8/1993 | Krent et al. |
| 5,237,703 | A | | 8/1993 | Brine et al. |
| 5,253,365 | A | | 10/1993 | Clevenhagen |
| 5,257,418 | A | | 11/1993 | Jaskiewicz |
| 5,309,573 | A | | 5/1994 | Solar et al. |
| 5,323,490 | A | | 6/1994 | Yarbrough |
| 5,328,652 | A | | 7/1994 | Thomson |
| 5,329,639 | A | | 7/1994 | Aoki |
| 5,330,391 | A | | 7/1994 | Mitchell |
| 5,345,609 | A | | 9/1994 | Fabry et al. |
| 5,379,460 | A | | 1/1995 | Aoki |
| D356,203 | S | | 3/1995 | Mitch |
| D360,284 | S | | 7/1995 | Paffett et al. |
| 5,435,008 | A | | 7/1995 | Shane |
| 5,442,815 | A | | 8/1995 | Cordova et al. |
| 5,442,816 | A | | 8/1995 | Seketa |
| 5,459,878 | A | | 10/1995 | Gold |
| 5,462,280 | A | | 10/1995 | Dickerson |
| 5,471,682 | A | | 12/1995 | Robins et al. |
| 5,477,558 | A | | 12/1995 | Völker et al. |
| 5,488,739 | A | | 2/1996 | Cardinal |
| 5,490,290 | A | | 2/1996 | Gold |
| 5,500,955 | A | | 3/1996 | Gongea |
| 5,511,242 | A | | 4/1996 | Bianchi |
| 5,511,243 | A | | 4/1996 | Hall et al. |
| 5,511,244 | A | | 4/1996 | Shikatani |
| 5,530,967 | A | | 7/1996 | Cielo |
| 5,551,083 | A | | 9/1996 | Goldsmith |
| 5,557,803 | A | | 9/1996 | Granich et al. |
| 5,564,122 | A | | 10/1996 | Wagner |
| 5,575,005 | A | | 11/1996 | Walker et al. |
| 5,581,809 | A | | 12/1996 | Mah |
| 5,592,688 | A | | 1/1997 | LaRonge et al. |
| 5,598,582 | A | | 2/1997 | Andrews et al. |
| 5,600,853 | A | | 2/1997 | Yewer, Jr. |
| 5,608,912 | A | | 3/1997 | Cumberland |
| 5,608,915 | A | | 3/1997 | Libit |
| 5,634,214 | A | | 6/1997 | St. Ville |
| 5,638,548 | A | | 6/1997 | Kawakami |
| 5,640,712 | A | | 6/1997 | Hansen et al. |
| 5,644,795 | A | | 7/1997 | Landis et al. |
| 5,655,221 | A | | 8/1997 | Worischeck |
| 5,655,226 | A | | 8/1997 | Williams |
| 5,659,897 | A | | 8/1997 | Satoh et al. |
| D385,667 | S | | 10/1997 | Goldsmith et al. |
| 5,675,839 | A | | 10/1997 | Gordon et al. |
| 5,678,245 | A | | 10/1997 | Rector et al. |
| 5,682,613 | A | | 11/1997 | Dinatale |
| 5,685,014 | A | | 11/1997 | Dapsalmon |
| 5,692,242 | A | | 12/1997 | Tekerman et al. |
| 5,694,642 | A | | 12/1997 | Rector et al. |
| 5,697,103 | A | | 12/1997 | Wiggins |
| 5,697,104 | A | | 12/1997 | Welton |
| D389,283 | S | | 1/1998 | Goldsmith et al. |
| 5,708,979 | A | | 1/1998 | Redwood et al. |
| 5,715,539 | A | | 2/1998 | Benecki et al. |
| 5,717,994 | A | | 2/1998 | Goldsmith |
| 5,717,995 | A | | 2/1998 | Murai |
| 5,720,047 | A | | 2/1998 | Spitzer |
| 5,745,916 | A | | 5/1998 | Linner |
| 5,761,745 | A | * | 6/1998 | Sato ..... 2/161.2 |
| 5,781,929 | A | | 7/1998 | Shikatani |
| 5,781,931 | A | | 7/1998 | Lee |
| 5,785,617 | A | | 7/1998 | MacKay, Jr. |
| 5,787,506 | A | | 8/1998 | Wilder et al. |
| 5,790,980 | A | | 8/1998 | Yewer, Jr. |
| 5,799,327 | A | | 9/1998 | Clevenhagen |
| 5,802,614 | A | | 9/1998 | Melone, Jr. |
| 5,806,092 | A | | 9/1998 | Shikatani |
| 5,809,571 | A | | 9/1998 | Spitzer |
| 5,815,839 | A | | 10/1998 | Safford |
| 5,815,840 | A | | 10/1998 | Hamlin |
| 5,819,312 | A | | 10/1998 | Snyder et al. |

| | | | | |
|---|---|---|---|---|
| 5,855,022 | A | 1/1999 | Storto | |
| 5,878,436 | A | 3/1999 | Jones | |
| 5,884,329 | A | 3/1999 | Goldsmith et al. | |
| 5,887,282 | A | 3/1999 | Lenhart | |
| 5,893,172 | A | 4/1999 | Haynes et al. | |
| 5,898,938 | A | 5/1999 | Baylor et al. | |
| 5,898,942 | A | 5/1999 | Anderson | |
| 5,926,847 | A | 7/1999 | Eibert | |
| 5,946,720 | A | 9/1999 | Sauriol | |
| 5,963,985 | A | 10/1999 | Behr et al. | |
| 5,983,396 | A | 11/1999 | Morrow et al. | |
| 5,987,642 | A | 11/1999 | Webster | |
| 5,987,646 | A | 11/1999 | Bolmer | |
| D417,757 | S | 12/1999 | Aoki | |
| 5,996,117 | A | 12/1999 | Goldsmith et al. | |
| 6,000,059 | A | 12/1999 | Abts | |
| 6,016,571 | A | 1/2000 | Guzman et al. | |
| D420,173 | S | 2/2000 | Aoki | |
| D420,174 | S | 2/2000 | Aoki | |
| D420,202 | S | 2/2000 | Redwood et al. | |
| 6,035,443 | A | 3/2000 | Green | |
| 6,041,438 | A | 3/2000 | Kirkwood | |
| 6,049,910 | A | 4/2000 | McCarter | |
| 6,052,827 | A | 4/2000 | Widdemer | |
| 6,065,150 | A | 5/2000 | Huang | |
| D426,922 | S | 6/2000 | Redwood et al. | |
| 6,085,352 | A | 7/2000 | Martin | |
| 6,088,835 | A | 7/2000 | Perkins et al. | |
| 6,098,200 | A | 8/2000 | Minkow et al. | |
| 6,105,162 | A | 8/2000 | Douglas et al. | |
| 6,122,769 | A | 9/2000 | Wilder et al. | |
| D431,691 | S | 10/2000 | Redwood et al. | |
| 6,182,289 | B1 | 2/2001 | Brown | |
| 6,185,747 | B1 | 2/2001 | Hughes | |
| 6,216,276 | B1 | 4/2001 | Eibert | |
| 6,223,350 | B1 | 5/2001 | McFarlane | |
| 6,223,744 | B1 | 5/2001 | Garon | |
| 6,226,795 | B1 | 5/2001 | Winningham | |
| 6,233,744 | B1 | 5/2001 | McDuff | |
| 6,249,915 | B1 | 6/2001 | Hang | |
| 6,253,382 | B1 | 7/2001 | Kleinert | |
| 6,256,792 | B1 | 7/2001 | MacDonald | |
| D445,996 | S | 8/2001 | Kiernan | |
| 6,275,996 | B1 | 8/2001 | Redwood et al. | |
| 6,279,160 | B1 | 8/2001 | Chen | |
| 6,279,163 | B1 | 8/2001 | Hale et al. | |
| 6,289,515 | B1 | 9/2001 | Fous | |
| 6,289,516 | B1 | 9/2001 | Motooka et al. | |
| 6,321,387 | B1 | 11/2001 | Fukae | |
| 6,353,931 | B1 | 3/2002 | Gilligan et al. | |
| 6,378,925 | B1 | 4/2002 | Greenlee | |
| 6,389,601 | B2 | 5/2002 | Kleinert | |
| 6,405,380 | B1 | 6/2002 | Kuroda et al. | |
| 6,415,444 | B1 | 7/2002 | Kleinert | |
| 6,415,445 | B1 * | 7/2002 | Nishijima et al. | 2/161.4 |
| D461,621 | S | 8/2002 | Bevier | |
| 6,427,247 | B1 | 8/2002 | Suk | |
| 6,430,745 | B2 | 8/2002 | Murai | |
| 6,453,474 | B2 | 9/2002 | Kleinert | |
| D464,178 | S | 10/2002 | Redwood et al. | |
| 6,460,184 | B1 | 10/2002 | Nishimura et al. | |
| 6,487,724 | B1 | 12/2002 | Aoki | |
| D468,075 | S | 1/2003 | Votel | |
| 6,502,244 | B1 | 1/2003 | Kleinert | |
| 6,516,470 | B1 | 2/2003 | Aoki | |
| 6,516,471 | B1 | 2/2003 | Baumann | |
| 6,519,781 | B1 | 2/2003 | Berns | |
| D471,343 | S | 3/2003 | Sun | |
| D471,674 | S | 3/2003 | Redwood et al. | |
| 6,526,592 | B1 | 3/2003 | Best | |
| 6,536,046 | B1 * | 3/2003 | Gilligan | 2/19 |
| 6,543,058 | B2 | 4/2003 | Litke et al. | |
| D474,863 | S | 5/2003 | Sun | |
| D474,963 | S | 5/2003 | Gersten et al. | |
| 6,571,394 | B1 | 6/2003 | Hackett et al. | |
| 6,584,616 | B2 | 7/2003 | Godshaw et al. | |
| 6,651,255 | B1 | 11/2003 | Schild | |
| 6,662,942 | B1 | 12/2003 | Bonzagni | |
| 6,668,379 | B2 | 12/2003 | Kleinert | |
| 6,681,402 | B1 | 1/2004 | Bevier et al. | |
| 6,701,530 | B2 | 3/2004 | Kleinert | |
| 6,708,346 | B2 | 3/2004 | Terris et al. | |
| 6,715,152 | B2 | 4/2004 | Mazzarolo | |
| 6,721,960 | B1 | 4/2004 | Levesque et al. | |
| 6,732,377 | B1 | 5/2004 | Wilkinson | |
| 6,745,402 | B2 | 6/2004 | Caswell | |
| 6,760,923 | B1 | 7/2004 | Tate | |
| 6,760,924 | B2 | 7/2004 | Hatch et al. | |
| D495,097 | S | 8/2004 | Redwood et al. | |
| 6,775,847 | B2 | 8/2004 | Terris et al. | |
| D499,529 | S | 12/2004 | Kleinert | |
| D499,856 | S | 12/2004 | Kleinert | |
| 6,862,744 | B2 | 3/2005 | Kuroda et al. | |
| 6,961,960 | B2 | 11/2005 | Gold et al. | |
| D513,828 | S | 1/2006 | Bevier | |
| 7,000,256 | B2 | 2/2006 | Kleinert | |
| D516,277 | S | 3/2006 | Mattesky | |
| D529,236 | S | 9/2006 | Litke et al. | |
| 7,100,212 | B2 | 9/2006 | Jaeger | |
| D545,002 | S | 6/2007 | Voravan | |
| D549,398 | S | 8/2007 | Swartz et al. | |
| D554,808 | S | 11/2007 | Litke et al. | |
| D570,056 | S | 5/2008 | Metcalf | |
| 7,406,719 | B2 | 8/2008 | Aoki | |
| D583,527 | S | 12/2008 | Kleinert | |
| D583,528 | S | 12/2008 | Kleinert | |
| 7,464,446 | B2 | 12/2008 | Johansson | |
| D584,026 | S | 1/2009 | Kleinert | |
| 2001/0025382 | A1 | 10/2001 | Murai | |
| 2001/0054190 | A1 | 12/2001 | Kleinert | |
| 2002/0013961 | A1 | 2/2002 | Kleinert | |
| 2002/0040494 | A1 | 4/2002 | Kleinert | |
| 2002/0042940 | A1 | 4/2002 | Kuroda et al. | |
| 2002/0152536 | A1 | 10/2002 | Kuroda et al. | |
| 2003/0005506 | A1 | 1/2003 | Litke | |
| 2003/0050586 | A1 | 3/2003 | Domanski et al. | |
| 2003/0056273 | A1 * | 3/2003 | Kleinert | 2/19 |
| 2004/0016038 | A1 * | 1/2004 | Motooka et al. | 2/19 |
| 2004/0025226 | A1 | 2/2004 | Jaeger | |
| 2004/0025227 | A1 | 2/2004 | Jaeger | |
| 2004/0103465 | A1 | 6/2004 | Kleinert | |
| 2004/0107476 | A1 * | 6/2004 | Goldwitz | 2/159 |
| 2004/0123371 | A1 * | 7/2004 | Bryant, Sr. | 2/159 |
| 2004/0216207 | A1 | 11/2004 | Anderson | |
| 2005/0034213 | A1 * | 2/2005 | Bamber | 2/161.1 |
| 2005/0114982 | A1 | 6/2005 | Gremmert | |
| 2007/0150998 | A1 | 7/2007 | Atherton | |
| 2007/0209097 | A1 | 9/2007 | Iacullo | |
| 2008/0052799 | A1 | 3/2008 | Yoo | |
| 2008/0141435 | A1 | 6/2008 | Friedman | |

FOREIGN PATENT DOCUMENTS

| | | |
|---|---|---|
| JP | 401171849 | 7/1989 |
| JP | 09182825 | 7/1997 |
| JP | 02003020504 | 1/2003 |
| WO | 9716085 | 5/1997 |
| WO | WO- 03082036 | 10/2003 |

* cited by examiner

GLOVE WITH DORSAL SIDE KNUCKLE PROTECTIVE PADDING

BACKGROUND OF THE INVENTION

1. Field of the Invention

This invention relates to gloves for the human hand and specifically gloves to protect the dorsal side knuckle areas of the hand. More particularly, this invention relates to a glove which is useful for playing sports or in work wherein padding is provided to protect the dorsal side knuckle areas of the hand with minimum restriction of movement of the metacarpal-phalangeal joints of the fingers and the thumb.

2. Description of Related Art

Glove construction for protection of the human hand is well known. For example, U.S. Pat. No. 3,175,226 teaches a dress glove construction which completely covers the fingers and which includes resiliently expandable materials in selected areas to accommodate hands of different sizes. In contrast, U.S. Pat. No. 4,561,122 teaches a protective glove which has a wraparound construction for a protective glove which leaves the thumb and finger ends exposed. U.S. Pat. No. 5,345,609 teaches a protective glove which includes shock absorbing cells disposed at selected portions along the top of the glove. U.S. Pat. No. 5,790,980 teaches a hand glove with a polyurethane foam pad in the palm portion of the glove. U.S. Pat. No. 1,149,139 teaches a grip golf glove and includes a plurality of ventilating apertures which are positioned over or adjacent to the individual knuckles of each finger. U.S. Pat. No. 4,094,014 is directed to a workman's glove and teaches knuckle protecting surfaces which are added along a protective-hand enclosing sheet which is preferably porous and of rubber cloth or filamentary mesh with a plurality of knuckle protecting cushion pads disposed along the top rear surface of the glove and a transverse pad covers the knuckles on the back of the hand. Moreover, there are a number of patents for gloves which teach protection of the boney prominence areas of the hand. Although hand protection from direct shocks and abrasions is found in gloves with the current art, what is needed is a glove which provides protection for the dorsal side knuckle area of the hand while minimizing interference with the rotation of the metacarpalphalangeal joints of the fingers and thumb.

SUMMARY OF THE INVENTION

An object of the present invention is to provide a glove which protects the dorsal side knuckle area of the hand without unduly restriction of the metacarpalphalangeal joints of the fingers and thumb.

Another object of the present invention is to provide a glove for a human hand which may be useful in the playing of sports or in selected work environments wherein the knuckle areas of the hand are subjected to endeavors which may be injurious to the knuckles area of the hand.

A further object of the present invention is to provide a work glove particularly for use in work areas where the wearer is constantly abrading or subjecting the knuckle area to contact with work pieces such as, for example, an automobile engine or the like.

More particularly, the present invention provides a glove for protection of the dorsal side knuckle area of the hand. The glove is provided with a covering for the hand with separate elongated sections to receive a plurality of fingers therein. A first protective pad is attached along a dorsal side of the covering and is located below the center axis of rotation of the metacarpalphalangeal joint of the fingers. A second protective pad is attached to the dorsal side of the covering and is located above the center axis of rotation of the metacarpal-phalangeal joints of the fingers. There is an absence of padding at the metacarpalphalangeal joints of the fingers.

Further objects and advantages of this invention will appear from the following description and appended claims, reference being had to the accompanying drawings forming a part of the specification and in like reference characters which designate corresponding parts in the several views.

DESCRIPTION OF THE PREFERRED EMBODIMENT

Figure 1:
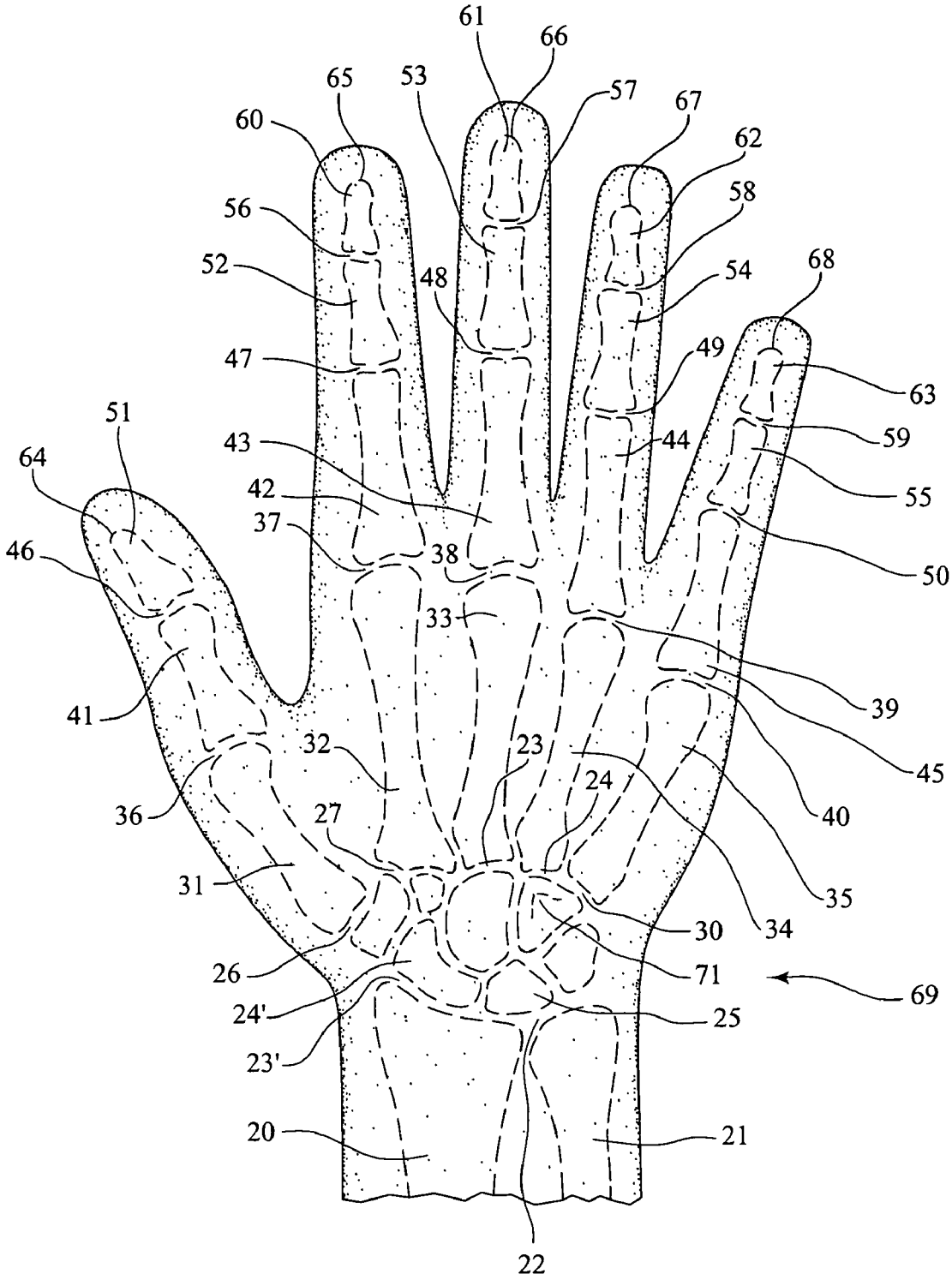
FIG. 1 is a top schematic anatomical skeletal structure of a right side human hand showing a dorsal-side detail.

FIG. 1 is a schematic anatomical view of the skeletal structure of the dorsal side of a right human hand 10. Shown are the radius 20, ulna 21, radio carpal joint (RC) 23', distal radio ulnar joint (DRUJ) 22, thumb 64, index finger 65, long finger 66, ring finger 67, and small or little finger 68. The carpus 69 comprises eight carpal bones, seven of which are shown in FIG. 1 and includes the hamate bone 71 with its hook-like protrusion, the scaphoid 24' and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small or little finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 2:
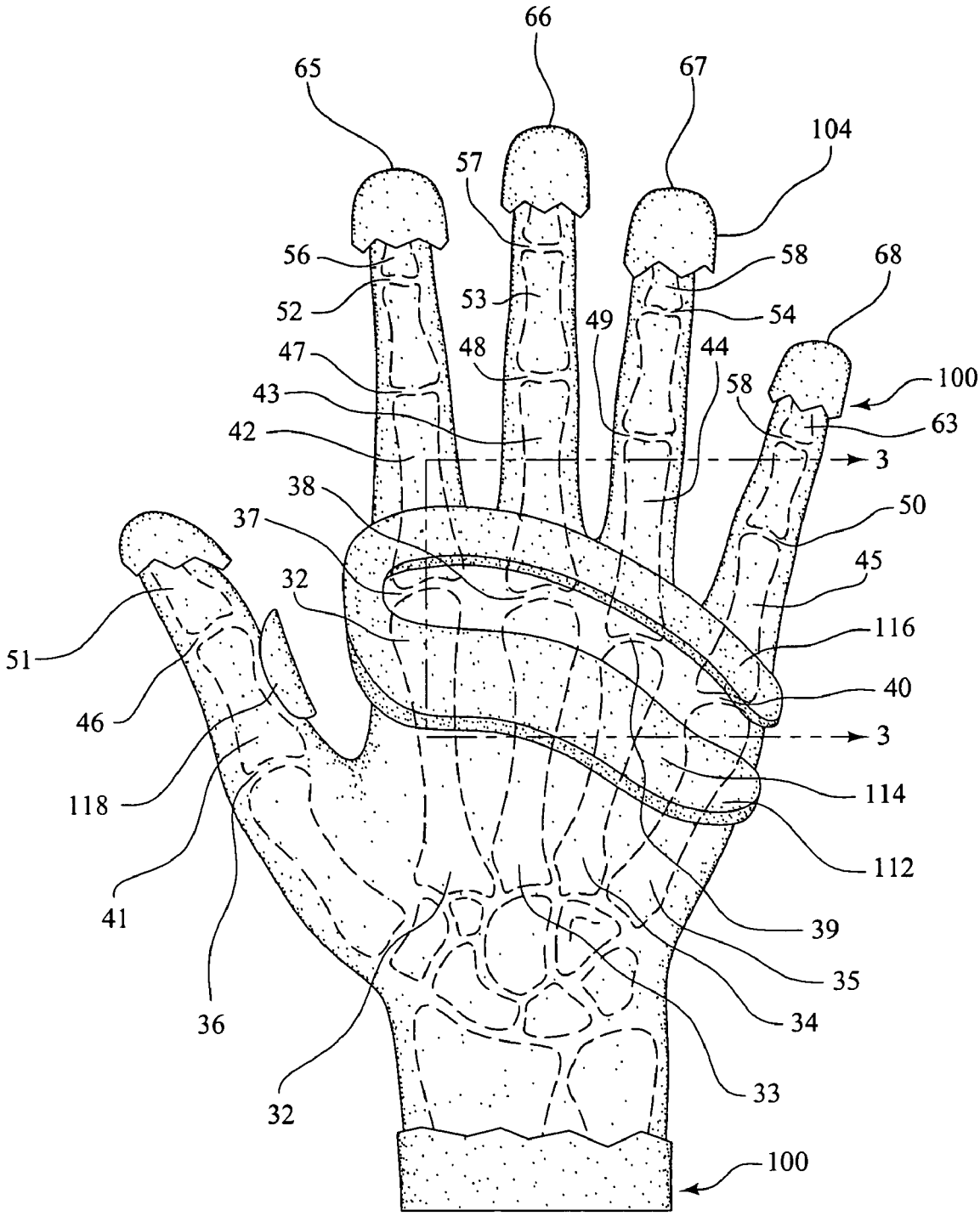
FIG. 2 is a top view showing the positioning for padding of a preferred glove of the present invention showing the dorsal-side detail and seen overlapping the skeletal structure of FIG. 1.
Figure 6:
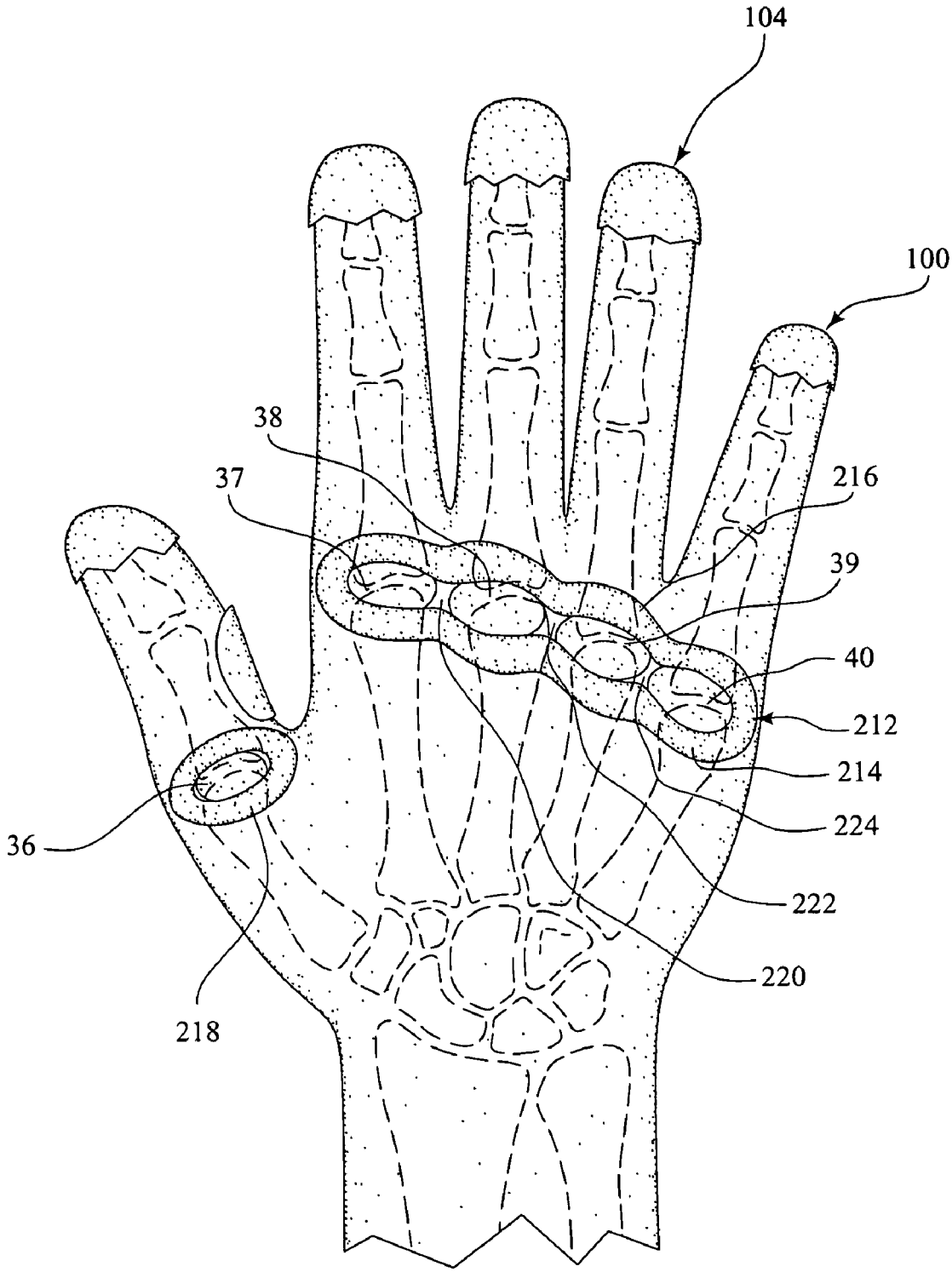
FIG. 6 is a top view showing the positioning of padding of another preferred glove of the present invention showing the dorsal-side detail and seen overlaying the skeletal structure of FIG. 1.
Figure 7:
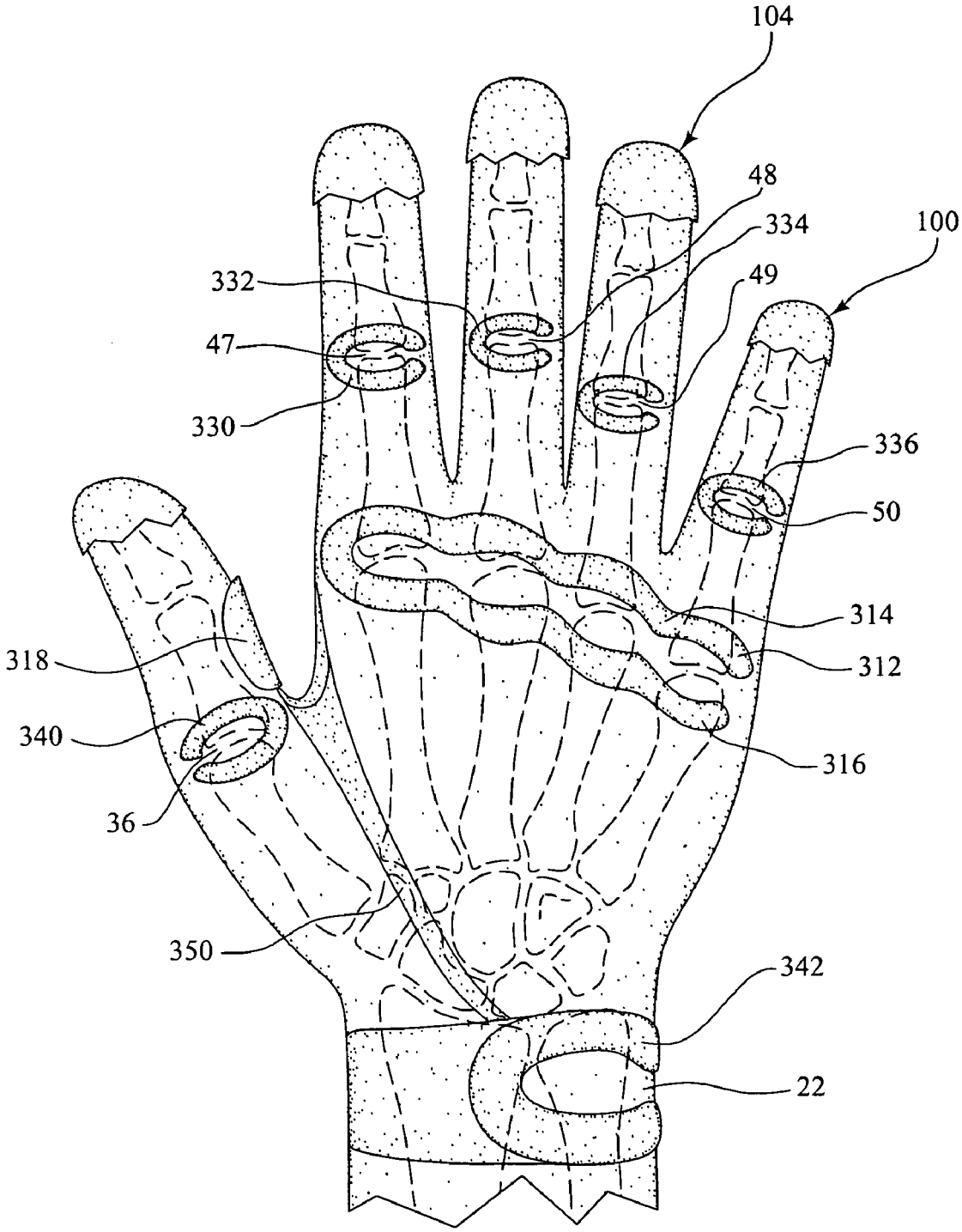
FIG. 7 is a top view showing the positioning for padding of even another preferred glove of the present invention showing the dorsal-side detail and seen overlaying the skeletal structure of FIG. 1.

In FIGS. 2, 6 and 7 are three embodiments showing the positioning of padding of the present invention overlaying the skeletal structure of the dorsal side of the human hand. These FIGS. show only a right hand but it is realized that a left hand utilizes symmetrical placement of the padding, materials, thicknesses and the like herein described.

Figure 4:
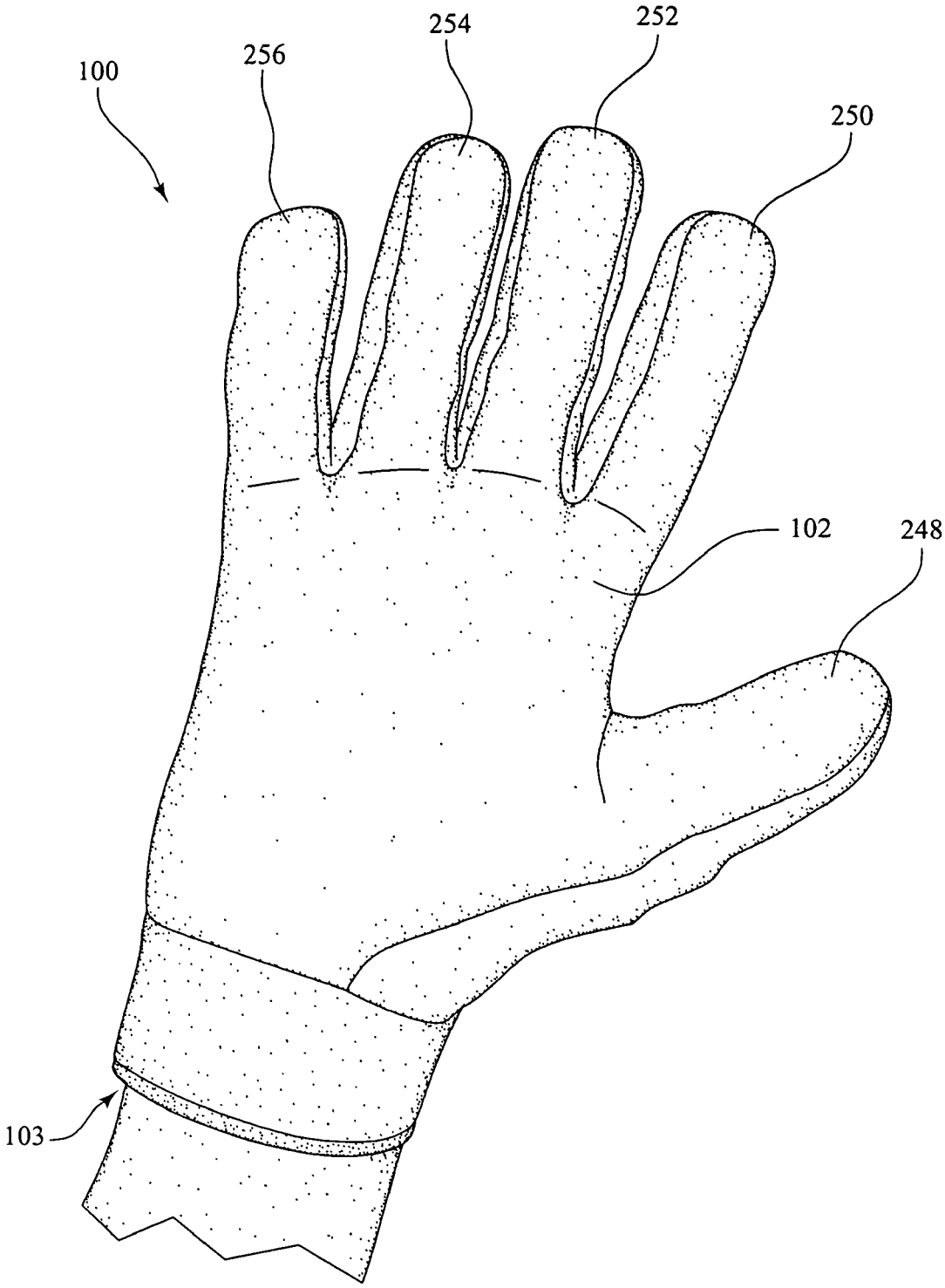
FIG. 4 is a perspective view of the preferred embodiment of the glove of the present invention showing the palm-side of the glove.
Figure 5:
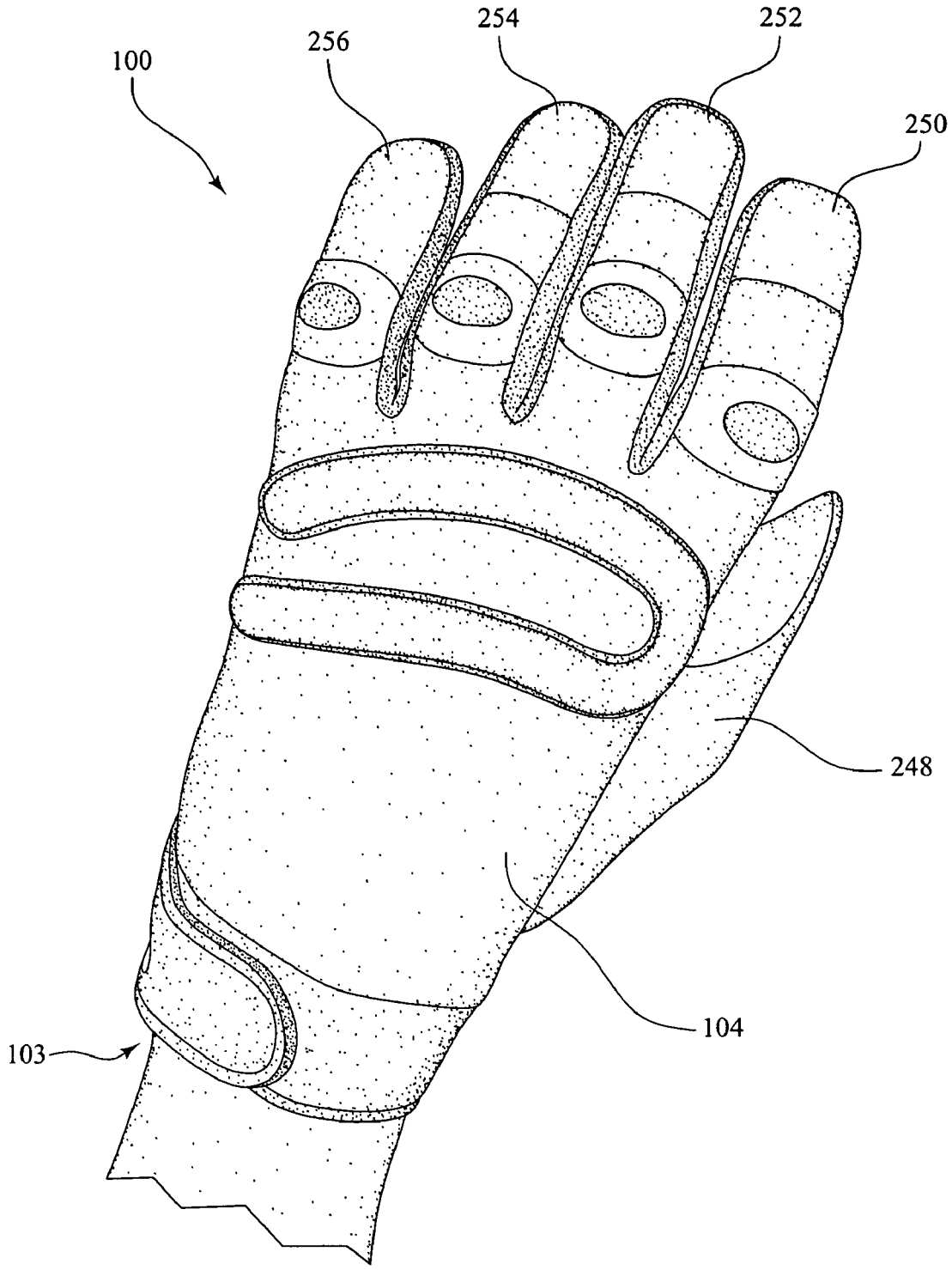
FIG. 5 is a perspective view of the preferred embodiment of the glove of the present invention showing the dorsal-side of the glove.

As best shown in FIGS. 4 and 5, a preferred glove 100, particular useful as a work glove, such as those used by auto mechanics which are constantly being rubbed and "banged" against metal parts of an automobile engine, is provided for the right human hand. The glove 100 includes a palmer side panel 102 and a dorsal side panel 104. The two panels are generally stitched or otherwise attached along their outer periphery and define a plurality of finger stalls and a thumb stall. The finger stalls are identified by the numerals 250 for the index finger, 252 for the long finger, 254 for the ring finger and 256 for the small finger. The thumb stall is identified as 248. The glove 100 is also provided with an opening 103 to receive the human hand therein. The glove panels 102, 104 are made of any suitable material known in the art, such as leather, or the like.

Figure 3:
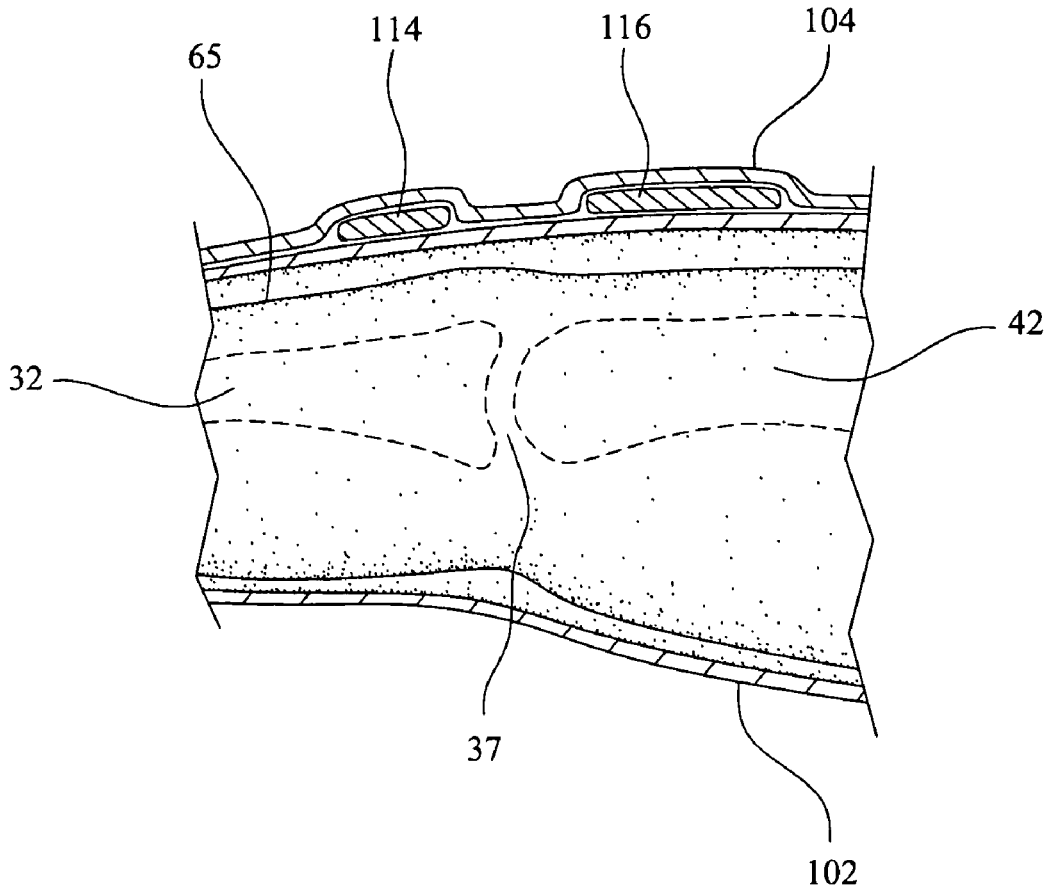
FIG. 3 is a cut-away section taken along line 3-3 of FIG. 2.

As best shown in FIGS. 2 and 3, the top portion of the dorsal side panel 104 covers a U-shaped pad 112 which includes a first pad portion 114 and a second pad portion 116. The first pad portion 114 extends along the distal end of the metacarpals 32, 33, 34 and 35 of the index finger, long finger, middle finger, ring finger and small finger, respectively. The second pad portion 116 extends along the proximal end of the proximal phalanxes 42, 43, 44 and 45 of the index finger, long finger, ring finger, middle finger and small finger respectively. The first pad 114 and the second pad 116 are positioned so that the center axis of rotation of the metacarpalphalangeal joints 37, 38, 39 and 40 of the index finger, long finger, ring finger, middle finger and small finger, respectively, are absent of padding. As shown, the U-shaped pad 112, including the first pad portion 114 and the second pad portion 116, is of unitary construction. As best shown in FIG. 3, the padding 114 and 116 extends above the knuckle area of the fingers so that in a bent condition the padding surrounds the knuckle but does not interfere with the bending movement and flexibility of the center axis of rotation of the metacarpalphalangeal joints of the fingers with an open end distal to the little finger 56. Also as shown in FIG. 2 is a third pad 118 which is provided along the proximal phalanx 41 of the thumb 64 below the interphalangeal joint 46 and above the metacarpalphalangeal joint 36 so that the joints 36 and 46 are absent of padding and therefore minimizes interference with movement and flexibility of the thumb.

Shown in FIG. 6 is another preferred embodiment of the present invention wherein the pad to protect the knuckle areas of the hand is of unitary construction as identified by the numeral 212. A first pad portion 214 is positioned to cover the same areas of the finger as the pad 114 as shown in FIG. 2 and the second pad portion identified by the numeral 216 is positioned to cover the same areas of the dorsal side of the hand as the second pad portion 116 in FIG. 2. Again, the center axis of rotation of the metacarpalphalangeal joints 37, 38, 39 and 40 are free of padding therefore providing relatively free movement of the knuckles. However, padding is provided between the center axis of rotation of the metacarpalphalangeal joints 37, 38, 39 and 40 to provide additional protection to the areas between the knuckles of each finger. The additional padding identified by the numeral 220 is positioned between the metacarpalphalangeal joints 37 and 38 whereas the padding 222 is positioned between the metacarpalphalangeal joints 38, 39 and padding identified by the numeral 224 is positioned between the metacarpalphalangeal joints 39 and 40. As shown, the pads 220, 222, 224 include ring shaped cut-outs surrounding each joint of each finger. Also, as shown in FIG. 6 a third pad 218 of oval construction is positioned to surround the center axis of rotation of the metacarpalphalangeal joint 36 of the thumb.

Shown in FIG. 7 is even another preferred embodiment of the present invention wherein the pad to protect the knuckles area of the hand includes generally U-shaped pad 312 with a first pad portion 314 and a second pad portion 316 which covers the same areas of the fingers as the pad 112 as shown in FIG. 2. The padding 312 is configured to include padding between the metacarpalphalangeal joints of the fingers also. Additionally, padding shown as U-shaped pads 330, 332, 334, and 336 are provided to protect the proximal interphalangeal joints 47, 48, 49 and 50 of the index finger, long finger, ring finger, middle finger and small finger, respectfully. U-shaped pads 330, 332, 334 and 336 are positioned to cover the distal end of the proximal phalanxes 42, 43, 44 and 45 and the proximal end of the middle phalanxes 52, 53, 54 and 55 with the absence of padding over the proximal interphalangeal joints 47, 48, 49 and 50. A generally U-shaped pad 340 is also provided to circumscribe the metacarpalphalangeal joint 36 of the thumb. Additionally, pad 318 is provided along the inside of the proximal phalanx 41 of the thumb 64. The pad 318 is positioned below the interphalangeal joint 46 and above the metacarpalphalangeal joint 36 of the thumb 64. Even further, a U-shaped pad 342 is provided to circumscribe the distal radio ulnar joint 22 of the wrist area of the hand.

Also in FIG. 7 an expansion motion zone 350 is provided to include additional flexibility in the use of the glove. Motion zone 350 includes an area extending along the inside of the glove between the thumb 64 and the index finger 65 to the wrist area. A thin strip of flexible material or webbing is generally provided in the area identified by the numeral 350 which enables easy expansion and movement of the thumb when in a use condition.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A protective glove comprising:

A covering for a human hand with separate elongated sections to receive a plurality of fingers therein, said covering having a top portion for covering a dorsal side of the hand including said elongated sections to receive a plurality of fingers, and, a lower portion to cover a palm side of a hand including a bottom side of said elongated section to receive said plurality of fingers and said thumb; and, a first protective pad positioned in said top portion for location below the center axis of rotation of the metacarpalphalangeal joints of the plurality of fingers and a second protective pad positioned along said top portion of said covering for location above the center axis of rotation of the metacarpalphalangeal joints of the plurality of fingers, said covering at said metacarpalphalangeal joints being absent of padding, said first and said second pad being of U-shaped unitary construction with an opened end distal to a little finger.

2. The glove of claim 1 including a third pad extending along the inside of the proximal phalanx of the thumb below the interphalangeal joint of the thumb and above the center axis of rotation of the metacarpalphalangeal joint of the thumb, said interphalangeal joint and said metacarpalphalangeal joint being absent of padding.

3. The glove of claim 1 including a padding circumscribing the metacarpalphalangeal joint of the thumb.

4. The glove of claim 1 wherein said first and said second pads extend above the knuckle area of a finger in a bent condition.

5. The glove of claim 1, said first and said second pads being of unitary construction with a ring shaped cut-out surrounding each metacarpalphalangeal joint of each finger.

6. The glove of claim 5 including padding above and below the center axis of rotation of the proximal interphalangeal joints of the fingers.

7. The glove of claim 1 including an expansion zone of a flexible material extending between the thumb and index finger of the glove to the wrist area of the hand.

8. The glove of claim 1 wherein a closed end of said U-shaped unitary construction is positioned along the inside of the metacarpalphalangeal joint of an index finger.

* * * * *